US008153342B2

(12) United States Patent
Izutani

(10) Patent No.: US 8,153,342 B2
(45) Date of Patent: Apr. 10, 2012

(54) DEVELOPER, AND IMAGE FORMING APPARATUS AND IMAGE FORMING METHOD USING THE DEVELOPER

(75) Inventor: Akira Izutani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 886 days.

(21) Appl. No.: 11/901,538

(22) Filed: Sep. 17, 2007

(65) Prior Publication Data

US 2008/0069594 A1 Mar. 20, 2008

(30) Foreign Application Priority Data

Sep. 19, 2006 (JP) ..... 2006-252047

(51) Int. Cl.
*G03G 9/06* (2006.01)

(52) U.S. Cl. ..... 430/105; 430/108.1; 430/111.1; 430/111.31; 430/111.32

(58) Field of Classification Search ..... 430/105, 430/108.1, 111.1, 111.31, 111.32
See application file for complete search history.

(56) References Cited

U.S. PATENT DOCUMENTS

| | | | | |
|---|---|---|---|---|
| 7,129,013 | B2 * | 10/2006 | Higuchi et al. | 430/108.4 |
| 7,144,669 | B2 * | 12/2006 | Suzuki et al. | 430/111.1 |
| 7,166,404 | B2 * | 1/2007 | Matsuda et al. | 430/111.35 |
| 7,169,522 | B2 * | 1/2007 | Sugiura et al. | 430/107.1 |
| 7,252,919 | B2 * | 8/2007 | Suzuki et al. | 430/111.1 |
| 7,344,812 | B2 * | 3/2008 | Suzuki et al. | 430/108.1 |
| 7,368,212 | B2 * | 5/2008 | Sugiura et al. | 430/109.4 |
| 7,413,838 | B2 * | 8/2008 | Sugiura et al. | 430/108.6 |
| 7,592,115 | B2 * | 9/2009 | Nakamura et al. | 430/110.3 |
| 7,595,138 | B2 * | 9/2009 | Yuasa | 430/108.11 |
| 7,611,815 | B2 * | 11/2009 | Sugiura et al. | 430/108.7 |
| 7,670,744 | B2 * | 3/2010 | Yuasa et al. | 430/137.14 |
| 7,687,216 | B2 * | 3/2010 | Kataoka et al. | 430/111.32 |
| 7,749,674 | B2 * | 7/2010 | Sugiura et al. | 430/137.16 |
| 2004/0234876 | A1 * | 11/2004 | Suzuki et al. | 430/97 |
| 2006/0222982 | A1 * | 10/2006 | Fujikawa | 430/106.1 |

FOREIGN PATENT DOCUMENTS

| | | |
|---|---|---|
| JP | 8-137206 | 5/1996 |
| JP | 3091323 | 7/2000 |
| JP | 2003-156982 | 5/2003 |
| JP | 2003-280251 | 10/2003 |
| JP | 2003-295542 | 10/2003 |
| JP | 2004-21178 | 1/2004 |
| JP | 2004-45571 | 2/2004 |
| JP | 2004-102099 | 4/2004 |
| JP | 2004-117464 | 4/2004 |
| JP | 2004-126357 | 4/2004 |
| JP | 2004-191656 | 7/2004 |
| JP | 2004-219855 | 8/2004 |
| JP | 2005-23463 | 1/2005 |
| JP | 2005-91396 | 4/2005 |
| JP | 2005-115214 | 4/2005 |
| JP | 2005-115216 | 4/2005 |
| JP | 2005-128144 | 5/2005 |
| JP | 2005-172946 | 6/2005 |
| JP | 2005-181864 | 7/2005 |
| JP | 2005-189799 | 7/2005 |
| JP | 2005-331749 | 12/2005 |
| JP | 2005-331822 | 12/2005 |

* cited by examiner

*Primary Examiner* — Hoa V Le
(74) *Attorney, Agent, or Firm* — Cooper & Dunham LLP

(57) ABSTRACT

A developer including a toner and a carrier, wherein the carrier is a ferrite carrier coated with a silicone resin and the following relationships are satisfied:

$$\log(\Delta Q(t)/Q_\infty)=-k_{ob}t$$

$$\Delta Q(t)=Q_\infty-Q(t)$$

$$-2.5 \leqq \log(k_{ob}) \leqq -1$$

wherein Q(t) is a charge quantity (μC/g) of the developer after t sec which is a stirring time of the toner and the carrier; $Q_\infty$ is a saturated charge quantity (μC/g) of the developer; and $k_{ob}$ is a chargeable speed of the developer.

18 Claims, 3 Drawing Sheets

【WHEN IMAGES ARE PRODUCED】

FREQ. 500Hz
DUTY 50%
Vpp: 1000V
Vdc: −600V

【NON-IMAGE AREA】

DC: −300V

DEVELOPER, AND IMAGE FORMING APPARATUS AND IMAGE FORMING METHOD USING THE DEVELOPER

BACKGROUND OF THE INVENTION

BACKGROUND

1. Technical Field

This disclosure relates to a developer for use in image forming apparatuses such as copiers, printers and facsimiles, wherein a collector collects an untransferred residual toner when forming an image while contacting an image bearer.

2. Discussion of the Related Art

Japanese Patent No. 3091323 discloses an image forming apparatus having an image developer capable of collecting untransferred toner remaining on the surface of an image bearer as well. Since the image developer is used as a cleaner as well, a cleaner is not independently needed. Therefore, the image forming apparatus can be largely downsized. In Japanese Patent No. 3091323, a contact charger contacting and charging the image bearer is disclosed.

Conventionally, contact or close contact charging methods of contacting or closely contacting a charger such as a charging roller to the surface of an image bearer, and corona charging methods charging the image bearer with corona charger, etc. are known. However, since the corona charger needs to discharge much such that the image bearer has a desired potential, discharge products such as ozone and NOx generate. On the contrary, the contact or close contact chargers are environmentally advantageous because of discharging less. Therefore, the image forming apparatus disclosed in Japanese Patent No. 3091323 can be downsized and less generates discharge products.

However, in such an image forming apparatus, the untransferred toner prevents the image bearer from being charged and an irradiator from irradiating the image bearer to from an electrostatic latent image thereon while transported to a developing area, resulting in deterioration of image density and production of defective images such as background fouling.

Japanese Published Unexamined Patent Application No. 8-137206 discloses an image forming apparatus wherein a charger and an untransferred toner collector are combined. The image forming apparatus has a charger combining a toner scraper, and collects the untransferred toner when forming an image. The collected toner is discharged from the charger onto a non-image area of the image bearer and collected at the image developer to prevent the defective irradiation due to the untransferred toner.

However, since the untransferred toner collected by the charger in Japanese Published Unexamined Patent Application No. 8-137206 is scraped between the image bearer and the charger, the untransferred toner has a charge quantity higher than normal when discharged onto the non-image area of the image bearer. Therefore, the untransferred toner is difficult to collect in the image developer because of being more electrostatically attracted to the image bearer. Even when collected in the image developer, the highly charged toner is mixed with the developer therein, resulting in deterioration of quality of images when produced for a long time. Particularly in an environment of low humidity, the toner discharged from the charger has much more charge quantity, resulting in production of images having background fouling and filming of the toner.

Because of these reasons, a need exists for a developer capable of downsizing image forming apparatuses and preventing deterioration of images due to an untransferred toner.

BRIEF SUMMARY OF THE INVENTION

In an aspect of this disclosure, there is provided a developer capable of downsizing image forming apparatuses and preventing deterioration of images due to an untransferred toner.

In another aspect, there is provided an image forming apparatus using the developer.

In another aspect, there is provided an image forming method using the developer.

In another aspect, there is provided a developer, comprising a toner and a carrier, wherein the carrier is a ferrite carrier coated with a silicone resin and the following relationships are satisfied:

$$\log(\Delta Q(t)/Q_\infty)=-k_{ob}t$$

$$\Delta Q(t)=Q_\infty-Q(t)$$

$$-2.5\leqq\log(k_{ob})\leqq-1$$

wherein Q(t) is a charge quantity (μC/g) of the developer after t sec which is a stirring time of the toner and the carrier; $Q_\infty$ is a saturated charge quantity (μC/g) of the developer; and $k_{ob}$ is a chargeable speed of the developer.

The aforementioned and other aspects, features and advantages will become apparent upon consideration of the following description of the preferred embodiments of this disclosure taken in conjunction with the accompanying drawings.

DESCRIPTION OF THE PREFERRED EMBODIMENTS

Figure 1:
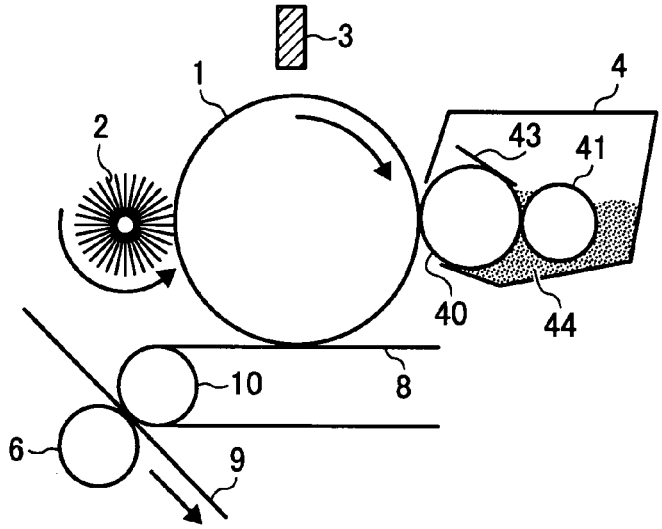
FIG. 1 is a schematic view illustrating an embodiment of the cleanerless image forming apparatus of the present invention.

Generally, the present invention provides a developer capable of downsizing image forming apparatuses and preventing deterioration of images due to an untransferred toner.

More particularly, the present invention provides a developer, comprising a toner and a carrier, wherein the carrier is a ferrite carrier coated with a silicone resin and the following relationships are satisfied:

$$\log(\Delta Q(t)/Q_\infty)=-k_{ob}t$$

$$\Delta Q(t)=Q_\infty-Q(t)$$

$$-2.5\leqq\log(k_{ob})\leqq-1$$

wherein Q(t) is a charge quantity (μC/g) of the developer after t sec which is a stirring time of the toner and the carrier; $Q_\infty$ is a saturated charge quantity (μC/g) of the developer; and $k_{ob}$ is a chargeable speed of the developer.

A serious problem of an image forming method of collecting an untransferred toner with an image developer to be recycled is that the untransferred toner is too highly charged at the image developer.

Therefore, the chargeable speed of the toner is controlled to be in a proper range such that the toner has both developability and collectability.

Specifically, the following relationships are satisfied:

$$\log(\Delta Q(t)/Q_\infty)=-k_{ob}t$$

$$\Delta Q(t)=Q_\infty-Q(t)$$

$$-2.5\leqq\log(k_{ob})\leqq-1$$

wherein Q(t) is a charge quantity (μC/g) of the developer after t sec which is a stirring time of the toner and the carrier; $Q_\infty$ is a saturated charge quantity (μC/g) of the developer; and $k_{ob}$ is a chargeable speed of the developer.

When $\log(k_{ob})$ is less than −2.5, the toner is charged low at the image developer and has low transportability, resulting in insufficient development and transfer. When greater than −1, the toner scraped between the charger and image bearer is charged too much to be collected with the image developer. Even when collected, the highly-charged toner is accumulated in the image developer, resulting in deterioration of image quality.

Q(t) is a charge quantity measured by a blowoff method at 7 stirring time standards of 1 sec, 10 sec, 30 sec, 60 sec, 10 min, 30 min and 60 min (∞).

$\log(\Delta Q(t)/Q_\infty)$ is determined using the 6 standards of Q(t) except for 60 min.

The carrier is a ferrite carrier coated with a silicone resin. The resin-coated carrier preferably has a core material including a coated layer formed of fluorine-modified silicone resins including an aminosilane coupling agent.

Specific examples of the core materials include an iron powder core material, a ferrite core material, a magnetite core material, a resin materials in which a magnetic material is dispersed, etc.

The ferrite core material typically has the following formula:

$$(MO)X(Fe_2O_3)Y$$

wherein M represents at least a member selected from the group consisting of Cu, Zn, Fe, Mg, Mn, Ca, Li, Ti, Ni, Sn, Sr, Al, Ba, Co and Mo. X and Y represent a mass molar ratio and X+Y=100. The ferrite carrier core is mainly formed of $Fe_2O_3$ mixed with at least a oxide of the member selected from the group consisting of Cu, Zn, Fe, Mg, Mn, Ca, Li, Ti, Ni, Sn, Sr, Al, Ba, Co and Mo.

The fluorine-modified silicone resin is preferably a crosslinked fluorine-modified silicone resin obtained from a reaction an organic silicon compound including a perfluoroalkyl group and polyorganosiloxane.

Specific examples of the aminosilane coupling agent include known agents such as γ-(2-aminoethyl)aminopropyltrimethoxysilane, γ-(2-aminoethyl)aminopropylmethyldimethoxysilane, octadecylmethyl[3-(trimethoxysilyl)propyl]ammoniumchloride (from the above, SH6020, SZ6023 and AY43-021 from Dow Corning Toray Silicone Co., Ltd.); and KBM602, KBM603, KBE903 and KBM573 from Shin-Etsu Chemical Industry Co., Ltd. Particularly, a primary amine is preferably used.

The resin-coated layer preferably includes the aminosilane coupling agent in an amount of from 5 to 40% by weight, and more preferably from 10 to 30% by weight. When less than 5% by weight, the aminosilane coupling agent does not work. When greater than 40% by weight, the resin-coated layer is crosslinked so much that it possibly causes a charge-up phenomenon, resulting in defective images insufficiently developed.

Methods of forming a coated layer on the carrier core material are not particularly limited, and include known coating methods, e.g., wet coating methods such as a dip coating method of dipping a core material powder in a layer coating liquid, a spray coating method of spraying a layer coating liquid on a core material, a fluidized bed coating method of spraying a layer coating liquid on a core material floated by a fluidizing air and a kneader coating method of mixing a core material and a layer coating liquid in a kneader to prepare a mixture and removing a solvent therefrom; and dry coating methods wherein a resin powder and a core material are mixed at a high speed such that the resin powder are fused to coat the surface of the core material with a frictional heat. The wet coating methods are preferably used in the present invention wherein fluorine-modified silicone resins including an aminosilane coupling agent are coated on a core material of the carrier.

Solvents for use in the layer coating liquid are not particularly limited if capable of solving the above-mentioned resin. Specific examples thereof typically include aromatic hydrocarbons such as toluene and xylene; ketones such as acetone and methyl ethyl ketone; and ethers such as tetrahydrofuran and dioxane. The resin-coated layer is preferably from 0.2 to 6.0% by weight, more preferably from 0.5 to 5.0% by weight, furthermore preferably from 0.6 to 4.0% by weight, and most preferably from 0.7 to 3% by weight.

After the core material is coated with the fluorine-modified silicone resins including an aminosilane coupling agent, the resultant carrier is preferably baked. The baking methods are not particularly limited, and either an external heating method or an internal heating method may be used. For example, a fixed or fluidized electric oven, a rotary kiln electric oven, a burner oven or a microwave oven may be used. The baking temperature is preferably from 200 to 350° C. to efficiently develop an effect of the fluorine-modified silicone resins, which improves the anti-spent of the resin-coated layer. The baking time is preferably from 1.5 to 2.5 hrs.

FIG. 1 is a schematic view illustrating an embodiment of the cleanerless image forming apparatus of the present invention, wherein a single color image forming process or one image developer is illustrated though forming full-color images. A charger 2, an irradiator 3, an image developer 4 and a transfer roller 6 sandwiching a transfer medium 9 are located around the periphery of a photoreceptor 1. An intermediate transferer 8 is preferably located with s suspension roller 10 when the image forming apparatus is a tandem image forming apparatus having individual photoreceptors for yellow (Y), magenta (M), cyan (C) and black (K).

Figure 2:
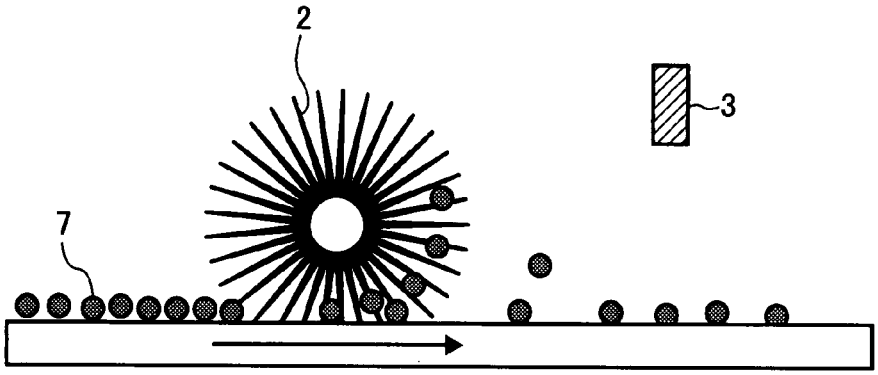
FIG. 2 is a schematic view and diagram for explaining collection and discharge of an untransferred toner and irradiation disorder.
Figure 2:
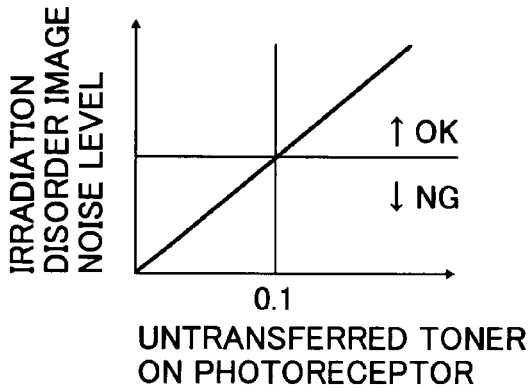

FIG. 2 is a schematic view and diagram for explaining collection and discharge of an untransferred toner and irradiation disorder. An untransferred toner 7 is charged less or reverse compared with the toner regularly charged. The untransferred toner 7 is collected by the charger 2 or passes through a collection member, and then the untransferred toner 7 is scraped between the photoreceptor 1 and the charger 2. Being scraped, the untransferred toner is charged higher than the toner regularly charged.

The image developer 4 collects the untransferred toner which is highly charged and has more electrostatic adherence causing poor collection of the toner at the image developer 4. Even when collected, irregular toners are stored, resulting in deterioration of image quality when repeatedly produced.

The charger 2 is charged with an AC voltage having an amplitude not less than twice as large as an initial voltage (Vth) and a DC voltage of from −400 to −800 V overlapping the AC voltage through a metallic shaft thereof, which is a desired charged voltage of the photoreceptor 1 such that the circumferential surface of the photoreceptor 1 is uniformly charged. The surface thereof is irradiated with light L1 including desired image information to form an electrostatic latent image thereon.

A developer 44 comprising a toner filled in the image developer 4 is fed by a feed roller 41 onto a developing roller 40. The developer is scraped between a charging member (a regulation blade) and the developing roller 40 to be frictionally charged. The charged toner fed on the developing roller 40 electrostatically adheres to the latent image on the photoreceptor 1 to form a toner image thereon.

A second transfer roller is located contacting the intermediate transferer suspended with a suspension roller. The intermediate transferer and the second transfer roller 6 form a second transfer nip therebetween, to which the transfer medium 9 as a recording material is fed at a predetermined time. The transfer medium 9 is contained in a paper feed cassette below the irradiator 3, and is transported to the second transfer nip with a paper feed roller, a registration roller, etc. Toner images overlapped on the intermediate transferer are transferred onto the transfer medium 9 at one time at the second transfer nip. At that time, a positive bias is applied to the second transfer roller 6 to form a transfer electric field transferring the toner image onto the transfer medium 9.

The untransferred toner remaining on the photoreceptor 1 is collected by the charger 2 when an image is formed. The charger 2 discharges the untransferred toner 7 onto a non-image area of the photoreceptor 1, and a bias of +200 V is applied to the image developer 4 to collect the toner therein. Then, the toner is stirred therein to be ready for another development.

It is known that the charger 2 contacts the photoreceptor 1 while contacting thereto. Conventionally, contact or close contact charging methods of contacting or closely contacting the charger 2 to the surface of the photoreceptor 1, and corona charging methods charging the photoreceptor 1 with corona charger, etc. are known. However, since the corona charger needs to discharge much such that the photoreceptor 1 has a desired potential, discharge products such as ozone and NOx generate. On the contrary, the contact or close contact chargers are environmentally advantageous because of discharging less.

In the present invention, therefore, the charger 2 contacts the photoreceptor 1 and rotates in the same direction of the photoreceptor. In order to improve collectability of the untransferred toner 7, the charger 2 and the photoreceptor 1 may have a difference of peripheral speed so as not to influence the charge of the photoreceptor 1. When the difference of peripheral speed is so large, the torque becomes high and the collected toner possibly scatters in the apparatus.

In the present invention, the peripheral surface of the photoreceptor 1 is uniformly charged and the untransferred toner 7 needs to be collected by the charger 2. However, the untransferred toner 7 does not need to be completely removed from the photoreceptor 1.

The present inventors discovered that a toner remaining on the surface of the photoreceptor 1 when a latent image is formed thereon increases deterioration of image quality more than a toner adhering to the charger 2. Namely, it is more important how a regular-charged toner passing a charging area and reaching a latent image forming area is prevented from adversely affecting a process of forming an image than a reverse-charged toner adhering to the charger 2. This is because a toner present in the latent image forming area, preventing the photoreceptor 1 from being irradiated, deteriorates image quality more than a toner adhering the charger 2 and possibly causing lowering of image density and background fouling.

Specifically, when the untransferred toner remains in the latent image forming area in an amount not greater than 0.1 $g/m^2$, the irradiation disorder does not occur. The charger 2 does not need to completely collect the untransferred toner 7 when an image is formed, and may collect the untransferred toner such that the irradiation disorder does not occur.

The charger 2 contacts the photoreceptor 1 and a DC voltage of from −400 to −800 V is applied to a metallic shaft of the charger 2 to charge the surface of the photoreceptor 1 as desired. However, the DC bias can not collect a regular-and-low charged (−) toner from the untransferred toner 7 including a reverse-charged (+) toner and the regular-and-low charged (−) toner. When the untransferred toner 7 includes many of the reverse-charged (+) toners, the irradiation disorder occurs.

Therefore, The charger 2 is charged with an AC voltage having an amplitude not less than twice as large as an initial voltage (Vth) having a frequency of about 500 Hz and a DC voltage of from −400 to −800V overlapping the AC voltage through a metallic shaft thereof, which is a desired charged voltage of the photoreceptor 1 such that the circumferential surface of the photoreceptor 1 is uniformly charged.

Thus, almost all the untransferred toners 7 including the reverse-charged (+) toners and the regular-and-low charged (−) toners can be collected at the charger 2.

The developer collected at the charger 2 is negatively-charged while held on a rotator, and discharged on the photoreceptor 1 when the AC bias applied to the brush charger is off. Then, a toner having high chargeability is highly charged due to a friction between the brush and the photoreceptor 1, and is discharged thereon while highly charged.

The charger 2 preferably has an indentation amount to the photoreceptor 1 of from 0.4 to 1.0 mm. When less than 0.4 mm, the photoreceptor 1 is unevenly charged. When greater than 1.0 mm, the torque of the apparatus is too high.

In addition, when the indentation amount is too large, the untransferred toner 7 is scraped more between the photoreceptor 1 and charger 2, it is more difficult for the image developer to collect the toner from the photoreceptor 1.

The charger 2 includes a rotating charger and a fixed charger formed of a brush material, a sponge material, an elastic rubber material, etc. The charger of the present invention is preferably the rotating charger collecting and temporarily holding the untransferred toner.

Electroconductive metallic brush materials include metallic fibers such as tungsten, stainless, gold, platinum, aluminum, iron and copper, the length or the diameter of which are optionally adjusted.

Electroconductive resin brush materials include resin fibers such as rayon, nylon, acetate, copper ammonium, vinylidene, vinylon, ethylene fluoride, benzoate, polyurethane, polyester, polyethylene, polyvinylchloride and polypropylene, in which resistivity adjusters such as carbon black, a carbon fiber, a metallic powder, a metallic whisker, a metal oxide and a semiconductive material are dispersed. The resistivity can be adjusted with the dispersed amount of the resistivity adjusters. The resistivity adjusters may be coated on the surface of the fiber.

The fiber materials preferably have a volume-resistivity not greater than $10^9$ Ω·cm, and more preferably not greater than $10^7$ Ω·cm to have good chargeability. The fiber may have a sectional shape which is easy to form, such as a circle, an oval, a circle having a waved perimeter, a polygon, a flat shape and a shape including a hollow.

The sponge materials include foamed resins such as polyurethane, polyethylene, polystyrene, melamine, natural rubber and silicone. The foamed polyurethane is preferably used because it is easy to control its elasticity; diameter, density and hardness of its foamed cell; and it has high durability. The sponge materials preferably have a volume-resistivity not greater than $10^9$ Ω·cm, and more preferably not greater than $10^7$ Ω·cm to have good chargeability. A resistivity adjuster such as carbon black can be included in the sponge materials and materials coating the sponge materials to adjust the resistivity.

The charge quantity of a toner depends on the relationship between the chargeable speed thereof and the charger 2. Particularly, a one-component developer is required to have a chargeable speed not less than a specific speed. Therefore, a charge controlling agent is included in a toner binder resin and a particulate silica is externally added to the toner to control the chargeable speed.

The toner for use in the present invention can be prepared a suspension polymerization method including mixing materials such as a monomer, a starter and a colorant; polymerizing the mixture; washing and separating the polymerized mixture; drying the washed and separated mixture; and other processes. The toner also be prepared by an emulsion polymerization method including monomer-polymerizing a monomer, a starter, an emulsifier and a dispersion medium; aggregating and associating the polymerized mixture; washing and separating the aggregated and associated mixture; drying the washed and separated mixture; and other processes. A mass polymerization method or a solution polymerization method may be used.

The binder resins of the toner include a polystyrene resin, a polyester resin, an epoxy resin, etc. The polyester resin, particularly a modified polyester resin is preferably used. Substituents modifying the polyester resin include a urea group, a urethane group, etc. The urea-modified polyester includes a reaction product between a polyester prepolymer having an isocyanate group and amines. The polyester prepolymer having an isocyanate group includes a product from a reaction between a polycondensate polyester of polyol and a polycarboxylic acid, having an active hydrogen group, and polyisocyanate. The active hydrogen group includes hydroxyl groups such as an alcoholic hydroxyl group and a phenolic hydroxyl group; amino groups; carboxyl groups; mercapto groups, etc. Among these groups, the alcoholic hydroxyl group is preferably used.

Specific examples of the colorants include any known dyes and pigments capable of preparing toners having colors of yellow, magenta, cyan and black, such as carbon black, lamp black, ultramarine, aniline blue, phthalocyanine blue, phthalocyanine green, HANSA YELLOW G, Rhodamine 6G, Lake, Calco Oil Blue, chrome yellow, quinacridone, benzidine yellow, Rose Bengal and triallylmethane dyes. These materials are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

Particularly, the metal salts of salicylic acid derivatives are preferably used. Optionally, a transparent or white material which does not spoil the color of a toner may be added to the charge controlling agent to stably charge the toner. Specific examples thereof include, but are not limited to, organic boron salts, fluorine-containing quaternary ammonium salts, calixarene compounds, etc.

When the external additive has a specific surface area less than 20 $m^2/g$, the external additive possibly does not adhere to the surface of the toner and is present alone. When greater than 50 $m^2/g$, the fluidity of the toner is improved so much that it is possible the charger 2 insufficiently collects the toner.

In the present invention, the parent toner preferably includes the external additive in an amount of from 0.05 to 3 parts by weight. When less than 0.05 parts by weight, the resultant toner does not have sufficient fluidity and it is not effectively prevents the resultant toner from being excessively charged. When greater than 3 parts by weight, the negatively-charged toner decreases and the positively-charged toner increases, resulting in increase of foggy images and reverse-transferred toner.

Specific examples of the external additive include silica, titanium oxide, aluminum oxide, various organic particulate material, various particulate metals, etc. The silica and titanium oxide are preferably used, and particularly the silica is more preferably used. The silica is typically prepared by a wet method or a dry method, and particularly so-called fumed silica prepared by the dry method (steam oxidization of a halogenated silicon compound) is preferably used in terms of fluidity.

Further, other halogenated metals such as aluminum chloride and titanium chloride may be combined with the halogenated silicon compound to prepare a complex fine powder of silica and other metal oxides, which can be used as the external additive of the present invention. The silica fine powder can be hydrophobized when surface-treated with a silane compound. Namely, a silane compounds is reacted with a hydrogen group combined with the silica fine powder to replace the hydroxyl group with a siloxyl group. Therefore, the hydrophobicity is a ratio of the hydroxyl groups disappeared due to the reaction to the hydroxyl groups present before hydrophobized. The silane compound such as dialkyl dihalogenated silane, trialkyl halogenated silane, hexaalkyldisilazane and alkyl trihalogenated silane is reacted with the silica fine powder at a high temperature to be hydrophobized.

The cleanerless image forming method includes the following processes:

(1) a process of developing a latent image on the photoreceptor 1 with a developer, i.e., a toner to form a toner image;

(2) a process of transferring the toner image onto a transfer material;

(3) a cleaning process of collecting a toner remaining on the photoreceptor 1 with a brush, etc. after transferred; and (4) a recycle process recycling the toner collected in the cleaning process, transporting the toner to the image developer when not developing a latent image.

In (1), the toner needs a charge potential not less than a specific potential because of being developed. The toner remaining on the photoreceptor 1 originally has insufficient chargeability because of being untransferred with a transfer bias and left. The toner collected in (3) and transported in (4) is scraped and charged again to be highly charged possibly, resulting in possible prevention of the collection recycle in (4).

The toner of the present invention is capable of performing its best chargeability in each process of (1) to (4).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is a developer, comprising a toner and a carrier, wherein the carrier is a ferrite (Cu—Zn) carrier coated with a silicone resin and the following relationships are satisfied:

$$\log(\Delta Q(t)/Q_\infty)=-k_{ob}t$$

$$\Delta Q(t)=Q_\infty-Q(t)$$

$$-2.5\leqq\log(k_{ob})\leqq-1$$

wherein Q(t) is a charge quantity (μC/g) of the developer after t sec which is a stirring time of the toner and the carrier; $Q_\infty$ is a saturated charge quantity (μC/g) of the developer; and $k_{ob}$ is a chargeable speed of the developer.

The following materials were dispersed in a HOMOMIXER for 10 min to prepare a silicone-resin coated layer forming liquid.

| | |
|---|---|
| Silicone resin solution [SR2410 from Dow Corning Toray Silicone Co., Ltd. including a solid content of 23% by weight] | 129.2 |
| Aminosilane [SH6020 from Dow Corning Toray Silicone Co., Ltd. including a solid content of 100% by weight] | 0.8 |
| Toluene | 300 |

After the liquid was spray-coated on 1 kg of a ferrite (Cu—Zn) carrier core material (F-150 having a diameter of 80 μm from Powdertech International Corp.) by a fluidized-bed coating method, the coated material was dried for 5 min and sieved with a sieve having an opening of 150 μm.

The sieved material was left and burned in an electric oven for 1 hr at 300° C. The burned material was pulverized with a sieve having an opening of 100 μm after cooled to prepare a carrier having a particle content of 50% by weight, a volume resistivity of 12.8 Log (Ω·cm), a magnetization of 68 $Am^2/kg$ and a volume-average particle diameter of 82.3 μm.

Example 1

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 0.5 parts of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}=-2.3$ from the relationship with the mixing time t.

Figure 3:
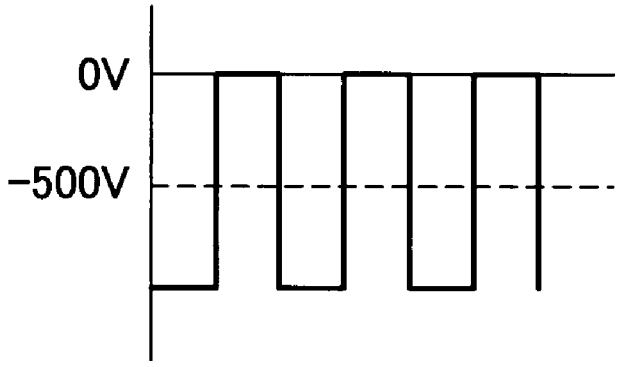
FIG. 3 is a schematic diagram for explaining the sequence of collecting and discharging an untransferred toner with a charger.
Figure 3:
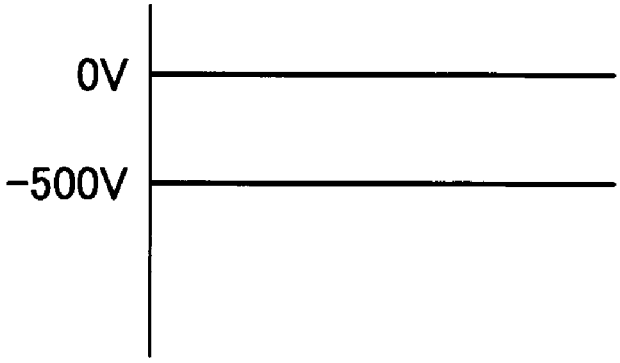

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 0.4 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 2

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 1 part of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2/g$ and a bulk density of 180 g/L were mixed in 100 parts of the parent toner with a Henschel Mixer such that the hydrophobic titanium oxide is externally added thereto prepare a toner.

Figure 4:
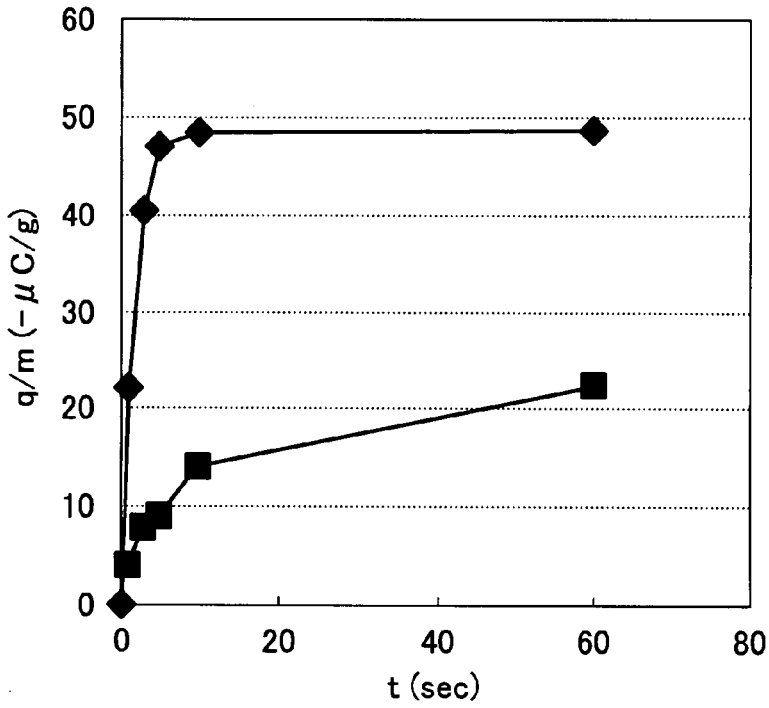
FIG. 4 is a schematic diagram showing the relationship between the charge quantity (q) and stirring time (t)
Figure 5:
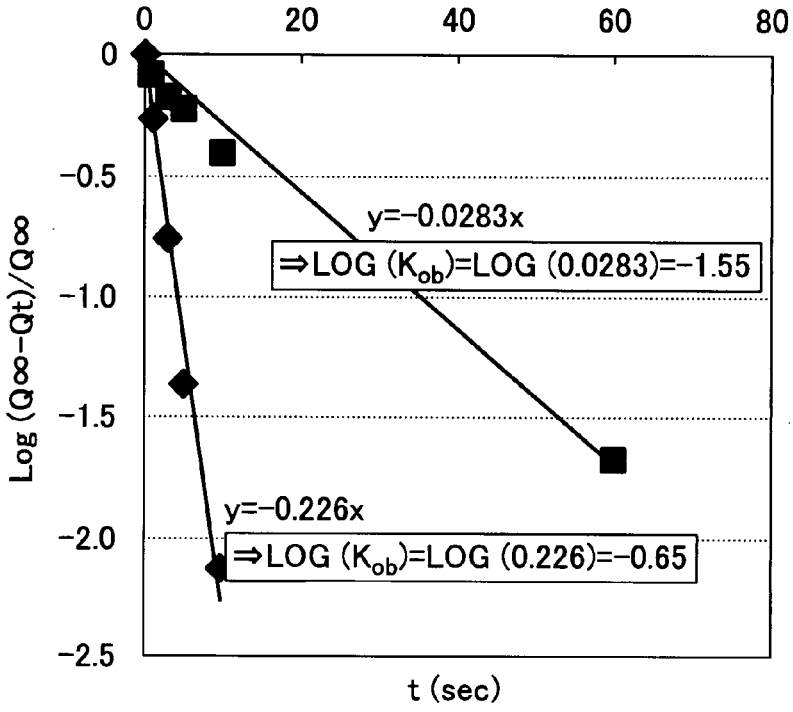
FIG. 5 is a schematic diagram showing the relationship between $\log(Q_\infty-Q(t)/Q_\infty)$ and time (t).

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed $k_{ob}$ thereof was determined from the relationship with the mixing time t. FIG. 4 is a schematic diagram showing the relationship between the charge quantity (q) and stirring time (t). FIG. 5 is a schematic diagram showing the relationship between $\log(Q_\infty - Q(t)/Q_\infty)$ and time (t). From FIGS. 4 and 5, $Q_\infty = -23$ μC/g and the chargeable speed $k_{ob} = -1.6$.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 0.4 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 3

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 2 parts of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob} = -1.2$ from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 0.4 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 4

The developer prepared in Example 1 was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 5

The developer prepared in Example 2 was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 6

The developer prepared in Example 3 was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 7

A monomer mixture including 80 parts of styrene monomer, 20 parts of butylacrylate and 5 parts of acrylic acid was added to a water-soluble mixture including 105 parts of water, 1 part of nonion emulsifier, 1.5 parts of anion emulsifier and 0.55 parts of potassium persulfate, and the resultant mixture was stirred at 70° C. for 8 hrs under a nitrogen stream. After polymerized, the mixture was cooled to prepare a lacteous emulsion including a particulate resin having a diameter of 0.25 μm. Next, 200 parts of the emulsion, 2 parts of a polyethylene wax emulsion from Sanyo Chemical Industries, Ltd., and 7 parts of copper phthalocyanine blue pigment were dispersed in water including 0.2 parts of surfactant, i.e., sodium dodecylbenzenesulfonate to prepare a dispersion.

After diethylamine was added to the dispersion to have a pH of 5.5, 0.3 parts of electrolyte aluminum sulfate was added thereto while stirred, and the dispersion is further dispersed by stirring the dispersion with TK homomixer at a high speed. Further, 40 parts of styrene monomer, 10 parts of butylacrylate, 5 parts of zinc salicylate and 40 parts of water were added to the dispersion, and the dispersion was heated to have a temperature of 90° C. while stirred under a nitrogen stream. Hydrogen peroxide was further added to the dispersion, and the dispersion was polymerized for 5 hrs to grow (assembled) particles.

After polymerized, the dispersion was heated to have a temperature of 95° C. while controlled to have a pH not less than 5, which was kept for 5 hrs. Then, the resultant particles were washed with water and vacuum-dried at 45° C. for 10 hrs to prepare a parent toner.

0.4 parts of a hydrophobic silica having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}=-2.4$ from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 8

1.0 parts of a hydrophobic silica having a surface area of 30 $m^2/g$ and a bulk density of 180 g/L were mixed in 100 parts of the parent toner prepared in Example 7 with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}=-1.3$ from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 9

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 0.4 parts of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}=-2.4$ from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 0.25 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Example 10

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 0.8 parts of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}$=−1.8 from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.6 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Comparative Example 1

240 parts of a polyester solution in ethylacetate/MEK solvent as a toner binder, 20 parts of pentaerythritoltetrabehenate having a melting point of 81° C. and a melt viscosity of 25 cps and 4 parts of copper phthalocyanine blue pigment were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.5 parts of a hydrophobic titanium oxide having a surface area of 30 $m^2$/g and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}$=−3.1 from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Comparative Example 2

240 parts of a polyester solution in ethylacetate/MEK solvent as a toner binder, 20 parts of pentaerythritoltetrabehenate having a melting point of 81° C. and a melt viscosity of 25 cps, 4 parts of copper phthalocyanine blue pigment and 3 parts of a nigrosine dye BONTRON-03 from Orient Chemical Industries, LTD. were stirred in a beaker with a TK homomixer at 12,000 rpm at 60° C. to be uniformly dissolved and dispersed to prepare a toner constituents solution. 706 parts of ion-exchanged water, 294 parts of hydroxyapatite suspension liquid having a concentration of 10% and 0.2 parts of sodium dodecylbenzenesulfonate were placed in a beaker to be uniformly dissolved to prepare a mixture. The mixture as heated to have a temperature of 60° C. and the toner constituents solution was placed therein while stirred with a TK homomixer at 12,000 rpm for 10 min. The mixed liquid was placed in a flask with a stirrer and a thermometer and heated to have a temperature of 98° C. to remove the solvent therefrom. The mixed liquid was further filtered, washed, dried and wind-classified to prepare a parent toner.

0.8 parts of a hydrophobic titanium oxide having a surface area of 30 $m^2$/g and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}$=−0.9 from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 0.6 mm. A DC bias −600 V was applied to a core metal of the nylon brushes as shown in FIG. 3 to produce 5,000 images.

Comparative Example 3

1.5 parts of a hydrophobic silica having a surface area of 30 $m^2$/g and a bulk density of 180 g/L were mixed in 100 parts of the parent toner prepared in Example 7 with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed $k_{ob}$ thereof was determined from the relationship with the mixing time t. FIG. 4 is a schematic diagram showing the relationship between the charge quantity (q) and stirring time (t). FIG. 5 is a schematic diagram showing the relationship between $\log(Q_\infty - Q(t)/Q_\infty)$ and time (t). From FIGS. 4 and 5, $Q_\infty$=−49 μC/g and the chargeable speed $k_{ob}$=−0.7.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

Comparative Example 4

A monomer mixture including 80 parts of styrene monomer, 20 parts of butylacrylate and 5 parts of acrylic acid was added to a water-soluble mixture including 105 parts of water, 1 part of nonion emulsifier, 1.5 parts of anion emulsifier and 0.55 parts of potassium persulfate, and the resultant mixture was stirred at 70° C. for 8 hrs under a nitrogen stream. After polymerized, the mixture was cooled to prepare a lacteous emulsion including a particulate resin having a diameter of 0.25 μm. Next, 200 parts of the emulsion, 2 parts of a polyethylene wax emulsion from Sanyo Chemical Industries, Ltd., and 7 parts of copper phthalocyanine blue pigment were dispersed in water including 0.2 parts of surfactant, i.e., sodium dodecylbenzenesulfonate to prepare a dispersion. After diethylamine was added to the dispersion to have a pH of 5.5, 0.3 parts of electrolyte aluminum sulfate was added thereto while stirred, and the dispersion is further dispersed by stirring the dispersion with TK homomixer at a high speed. Further, 40 parts of styrene monomer, 10 parts of butylacrylate, 5 parts of zinc salicylate and 40 parts of water were added to the dispersion, and the dispersion was heated to have a temperature of 90° C. while stirred under a nitrogen stream. Hydrogen peroxide was further added to the dispersion, and the dispersion was polymerized for 5 hrs to grow (assembled) particles.

After polymerized, the dispersion was heated to have a temperature of 95° C. while controlled to have a pH not less than 5, which was kept for 5 hrs. Then, the resultant particles were washed with water and vacuum-dried at 45° C. for 10 hrs to prepare a parent toner.

0.2 parts of a hydrophobic silica having a surface area of 30 $m^2/g$ and a bulk density of 180 g/L were mixed in 100 parts of the parent toner with a Henschel Mixer such that the hydrophobic titanium oxide is externally added thereto prepare a toner.

5 parts of the toner and 95 parts of a silicone-coated spherical carrier having an average particle diameter of 50 μm were mixed for 1 sec, 10 sec, 30 sec, 60 sec, 10 min, 30 min and 60 min to prepare developers. The charge quantity of each of the developers was measured by a blowoff charge measurer, and the chargeable speed thereof $k_{ob}$=−2.8 from the relationship with the mixing time t.

The developer was filled in the image developer of a marketed laser printer CX-3000 from Ricoh Company, Ltd., wherein the cleaning blade and the charger were replaced with a nylon brush having a diameter of 12 mm, 6 D (denier), a density 240 k brushes/inch and an original yarn resistivity of $10^4\Omega$ so as to have an indentation amount to the photoreceptor of 1.2 mm. A bias was applied to a core metal of the nylon brushes such that a frequency was 500 Hz, a peak-to-peak voltage was 1,000 V and a DC voltage was −600 V as shown in FIG. 3 to produce 5,000 images.

(Image Evaluation)

Background fouling will be explained.

After 5,000 images were produced, the reflectivity (%) of a blank part of each image produced in Examples 1 to 10 and Comparative Examples 1 to 4 was measured with a reflection densitometer X-rite 310TR. The difference between the reflectivity of an original recording medium an image was not produced on and the measured reflectivity was determined.

○: less than 5%

Δ: not less than 5% less than 10%

X: not less than 10%

Filming will be explained.

After 5,000 images were produced, the surface of each image bearer in Examples 1 to 10 and Comparative Examples 1 to 4 was taped with a tape and a toner adhered thereon was observed with an optical microscope.

○: almost no toner

Δ: slight toner

X: considerable toner

Image irregularity will be explained.

After 5,000 images were produced, each solid image produced in Examples 1 to 10 and Comparative Examples 1 to 4 was visually observed.

○: no image density irregularity

Δ: slight image density irregularity

X: stripe image density irregularity

The results are shown in Table 1.

TABLE 1

| | Developer | | Charger | | Image Evaluation | | |
|---|---|---|---|---|---|---|---|
| | Resin | $k_{ob}$ | Indentation | bias | Background fouling | Filming | Image irregularity |
| Example 1 | Polyester | −2.3 | 0.4 | AC + DC | ○ | ○ | ○ |
| Example 2 | Polyester | −1.6 | 0.4 | AC + DC | ○ | ○ | ○ |
| Example 3 | Polyester | −1.2 | 0.4 | AC + DC | ○ | ○ | ○ |
| Example 4 | Polyester | −2.3 | 1.2 | AC + DC | ○ | ○ | ○ |
| Example 5 | Polyester | −1.6 | 1.2 | AC + DC | ○ | ○ | ○ |
| Example 6 | Polyester | −1.2 | 1.2 | AC + DC | ○ | ○ | ○ |
| Example 7 | Styrene-acrylic | −2.4 | 1.2 | AC + DC | ○ | ○ | ○ |
| Example 8 | Styrene-acrylic | −1.3 | 1.2 | AC + DC | ○ | ○ | ○ |
| Example 9 | Polyester | −2.4 | 0.25 | AC + DC | ○ | ○ | Δ |
| Example 10 | Polyester | −1.8 | 1.6 | AC + DC | ○ | Δ | ○ |
| Comparative Example 1 | Polyester | −3.1 | 1.2 | AC + DC | X | ○ | ○ |
| Comparative Example 2 | Polyester | −0.9 | 0.6 | DC | ○ | ○ | X (irradiation disorder occurred) |
| Comparative Example 3 | Styrene-acrylic | −0.7 | 1.2 | AC + DC | Δ | X | ○ |
| Comparative Example 4 | Styrene-acrylic | −2.8 | 1.2 | AC + DC | X | ○ | ○ |

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2006-252047 filed on Sep. 19, 2006, the entire contents of which are herein incorporated by reference.

What is claimed is:

1. A one-component developer for a cleanerless image forming apparatus, said developer comprising a mixture of a toner and a carrier, wherein the carrier is a ferrite carrier coated with a silicone resin, wherein the toner includes a charge controlling agent to control a chargeable speed $k_{ob}$ of the developer, the charge controlling agent including at least one of a triphenylmethane dye, a metal complex dye comprising chromium, a chelate compound of molybdic acid, a rhodamine dye, an alkoxyamine substance, an alkylamide substance, a compound containing phosphor and a compound containing sulphur, and wherein the developer has a property of chargeable speed $k_{ob}$ satisfying the following conditions:

$$\log(\Delta Q(t)/Q_\infty)=-k_{ob}t$$

$$\Delta Q(t)=Q_\infty-Q(t)$$

$$-2.5\leqq\log(k_{ob})\leqq-1$$

wherein Q(t) is a charge quantity (μC/g) of the developer after t sec which is a stirring time of the toner and the carrier to form the mixture; $Q_\infty$ is a saturated charge quantity (μC/g) of the developer.

2. An image forming apparatus, comprising:

an image bearer configured to bear an image;

a charger configured to charge the image bearer to form an electrostatic latent image thereon;

an image developer configured to develop the electrostatic latent image with the developer according to claim 1 to form a toner image on the image bearer; and a transferer configured to transfer the toner image onto a recording medium, wherein the charger collects the developer remaining on the image bearer after the toner image is transferred when a following toner image is formed.

3. The developer of claim 1, wherein contents of the toner and contents of the carrier are adjusted in order to control the chargeable speed $k_{ob}$ of the developer.

4. The developer of claim 1, wherein the chargeable speed $k_{ob}$ of the developer is controlled in order to satisfy the condition: $-2.5\leqq\log(k_{ob})\leqq-1$.

5. The developer of claim 1, wherein contents of the toner and contents of the carrier are controlled such that the chargeable speed $k_{ob}$ of the developer is caused to satisfy the condition: $-2.5\leqq\log(k_{ob})\leqq-1$.

6. The developer of claim 1, wherein contents of the toner and contents of the carrier are controlled to adjust the charge quantity Q(t) of the developer at a plurality of stirring times t, such that the chargeable speed $k_{ob}$ of the developer is caused to satisfy the condition:

$$-2.5\leqq\log(k_{ob})\leqq-1$$

7. The developer of claim 1, wherein a content of the charge controlling agent in the toner is adjusted in order to control the chargeable speed $k_{ob}$ of the developer.

8. The developer of claim 1, wherein a content of the charge controlling agent in the toner is from 0.1 to 10 parts by weight per 100 parts by weight of a binder resin included in the toner, to cause the chargeable speed $k_{ob}$ of the developer to satisfy the condition: $-2.5\leqq\log(k_{ob})\leqq-1$.

9. The developer of claim 8, wherein the content of the charge controlling agents is from 0.2 to 5 parts by weight, per 100 parts by weight of the binder resin included in the toner.

10. The developer of claim 1, wherein a content of an external additive in the toner is adjusted in order to control the chargeable speed $k_{ob}$ of the developer.

11. The developer of claim 1, wherein the toner includes an external additive to cause the chargeable speed $k_{ob}$ of the developer to satisfy the condition: $-2.5\leqq\log(k_{ob})\leqq-1$.

12. The developer of claim 11, wherein the toner includes any one of hydrophobic titanium oxide and hydrophobic silica as an external additive.

13. The developer of claim 11, wherein the external additive is from 0.05 to 3 parts by weight per 100 parts by weight of a binder resin included in the toner.

14. The developer of claim 11, wherein an average surface area of particles of the external additive is in a range of $20m^2/g$ to $50\ m^2/g$.

15. The developer of claim 11, wherein the toner includes a halogenated silicon compound as an external additive.

16. The developer of claim 11, wherein the toner includes a halogenated silicon compound and at least one of aluminum chloride and titanium chloride, as external additives.

17. The developer of claim 11, wherein the toner includes, as an external additive, a halogenated silicon compound that is treated with a silane compound, the silane compound including at least one of dialkyl dihalogenated silane, trialkyl halogenated silane, hexaalkyldisilazane and alkyl trihalogenated silane.

18. The developer of claim 1, wherein the toner further includes at least one of an organic boron salt and a calixarene compound in addition to the charge controlling agent, to charge the toner.

* * * * *